US008720708B1

(12) United States Patent
Gilmore

(10) Patent No.: US 8,720,708 B1
(45) Date of Patent: May 13, 2014

(54) TABLE ASSEMBLY

(76) Inventor: James C. Gilmore, Cleveland, OH (US)

( * ) Notice: Subject to any disclaimer, the term of this patent is extended or adjusted under 35 U.S.C. 154(b) by 66 days.

(21) Appl. No.: 13/540,018

(22) Filed: Jul. 2, 2012

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47G 7/02*** | (2006.01) |
| ***A47G 29/00*** | (2006.01) |
| ***A47G 7/04*** | (2006.01) |
| ***A47H 27/00*** | (2006.01) |
| ***A47F 5/04*** | (2006.01) |
| ***A47F 7/00*** | (2006.01) |
| ***A47B 13/02*** | (2006.01) |
| ***A47B 96/02*** | (2006.01) |
| *A47B 47/02* | (2006.01) |
| *A47B 37/04* | (2006.01) |

(52) U.S. Cl.

CPC ..... *A47G 7/041* (2013.01); *A47H 27/00* (2013.01); *A47F 5/04* (2013.01); *A47F 7/0078* (2013.01); *A47B 13/023* (2013.01); *A47B 47/022* (2013.01); *A47B 96/02* (2013.01); *A47B 96/027* (2013.01); *A47B 37/04* (2013.01)

USPC ..... 211/205; 211/85.23; 211/133.4; 211/196; 108/92

(58) Field of Classification Search

CPC ..... A01G 9/02; A01G 9/023; A47H 27/00; A47G 7/041; A47G 7/00; A47G 7/02; A47G 7/04; A47F 5/04; A47F 5/05; A47F 5/06; A47F 7/0078; A47F 5/10; A47F 5/106; A47B 2013/02; A47B 2013/023; A47B 3/00; A47B 9/00; A47B 7/00; A47B 13/00; A47B 13/02; A47B 13/023; A47B 31/04; A47B 43/04; A47B 47/00; A47B 47/0066; A47B 47/0075; A47B 47/022; A47B 47/02; A47B 47/04; A47B 55/00; A47B 57/00; A47B 83/04; A47B 83/00; A47B 96/02; A47B 96/027; A47B 37/04; A47B 87/0223; A47B 3/12; A47B 57/045

USPC ..... 211/88.03, 85.23, 144, 196, 205, 133.4, 211/166, 107, 193, 134, 189, 186, 187; 108/92, 94, 101, 103

See application file for complete search history.

(56) References Cited

U.S. PATENT DOCUMENTS

| | | | | | |
|---|---|---|---|---|---|
| 1,145,205 | A | * | 7/1915 | Mills, Jr. | 108/101 |
| 1,401,057 | A | * | 12/1921 | Elliott | 108/101 |
| 1,797,077 | A | | 3/1931 | Dew et al. | |
| 1,817,878 | A | * | 8/1931 | Clements, Jr. | 182/33.5 |
| 3,358,621 | A | * | 12/1967 | Szacsko | 108/92 |
| 3,831,533 | A | * | 8/1974 | Kellogg | 108/64 |
| 3,853,074 | A | * | 12/1974 | Madey | 108/101 |
| D244,075 | S | * | 4/1977 | Imber et al. | D6/474 |
| 4,099,472 | A | * | 7/1978 | Kellogg | 108/185 |
| D253,980 | S | * | 1/1980 | Schriever | D6/474 |

(Continued)

*Primary Examiner* — Jennifer E Novosad

(57) ABSTRACT

An adjustable table assembly provides a swinging tabletop surface and plant stand positionable adjacent to seats in a substantially fixed position. The assembly includes a post having an upper end and a lower end. A base is coupled to the lower end of the post. A shelf is coupled to and extends from the post. An upper panel is coupled to and extends from the post. The upper panel is pivotally coupled to the post. A support assembly is coupled to and extends downwardly from the shelf. The support assembly has a bottom panel and a vertical panel coupled to and extending upwardly from a top surface of the bottom panel.

15 Claims, 3 Drawing Sheets

(56) References Cited

U.S. PATENT DOCUMENTS

| | | | | | |
|---|---|---|---|---|---|
| 4,345,526 | A | * | 8/1982 | Streit | 108/191 |
| 4,579,311 | A | * | 4/1986 | Spranza, III | 248/553 |
| 4,878,685 | A | | 11/1989 | Bahm | |
| 4,938,364 | A | * | 7/1990 | Stadelman et al. | 211/47 |
| 5,400,719 | A | * | 3/1995 | Santapa et al. | 108/64 |
| 5,522,514 | A | * | 6/1996 | Robinson | 211/188 |
| 5,842,425 | A | * | 12/1998 | van der Aa | 108/64 |
| D413,046 | S | * | 8/1999 | Fritze | D7/610 |
| 6,158,357 | A | * | 12/2000 | Shih | 108/50.01 |
| 6,477,966 | B1 | | 11/2002 | Petryna | |
| 6,550,402 | B1 | * | 4/2003 | Stone et al. | 108/91 |
| 7,334,593 | B2 | | 2/2008 | Avery | |
| D574,166 | S | | 8/2008 | Kaisler | |
| 7,770,743 | B1 | * | 8/2010 | Janowak et al. | 211/119.12 |
| 7,798,076 | B1 | * | 9/2010 | Neff | 108/186 |
| 8,490,553 | B1 | * | 7/2013 | English et al. | 108/101 |
| 2002/0027117 | A1 | * | 3/2002 | Brandenberg | 211/205 |
| 2003/0075083 | A1 | * | 4/2003 | Devey | 108/92 |
| 2007/0012227 | A1 | * | 1/2007 | Owen | 108/101 |
| 2007/0034121 | A1 | * | 2/2007 | Kim | 108/92 |
| 2008/0061020 | A1 | | 3/2008 | Kaisler | |
| 2009/0122563 | A1 | | 5/2009 | Ko et al. | |

* cited by examiner

TABLE ASSEMBLY

BACKGROUND OF THE DISCLOSURE

Field of the Disclosure

The disclosure relates to table devices and more particularly pertains to a new table device for providing a swinging tabletop surface and plant stand positionable adjacent to seats in a substantially fixed position.

SUMMARY OF THE DISCLOSURE

An embodiment of the disclosure meets the needs presented above by generally comprising a post having an upper end and a lower end. A base is coupled to the lower end of the post. A shelf is coupled to and extends from the post. An upper panel is coupled to and extends from the post. The upper panel is pivotally coupled to the post. A support assembly is coupled to and extends downwardly from the shelf. The support assembly has a bottom panel and a vertical panel coupled to and extending upwardly from a top surface of the bottom panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
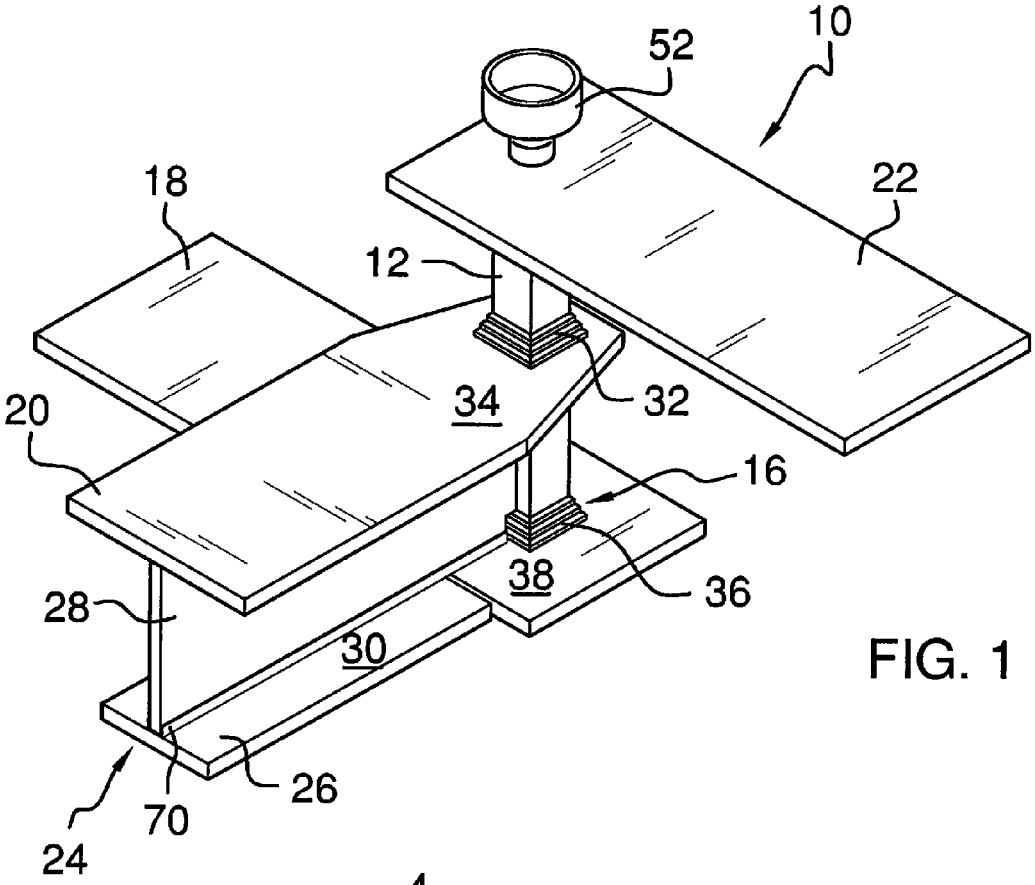
FIG. 1 is a top front side perspective view of a adjustable table assembly according to an embodiment of the disclosure.
Figure 2:
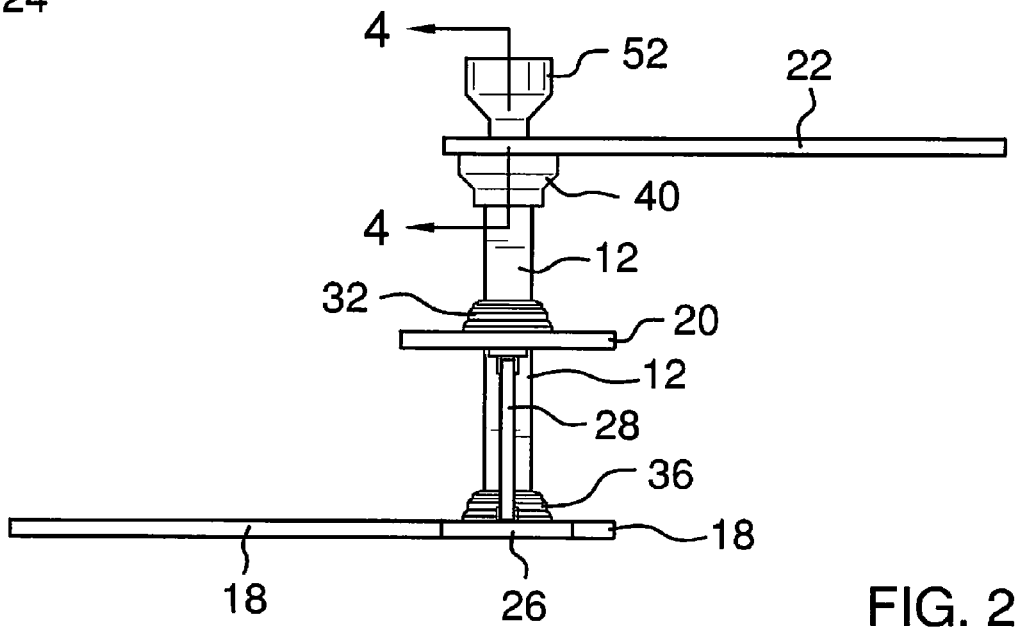
FIG. 2 is a side view of an embodiment of the disclosure.
Figure 3:
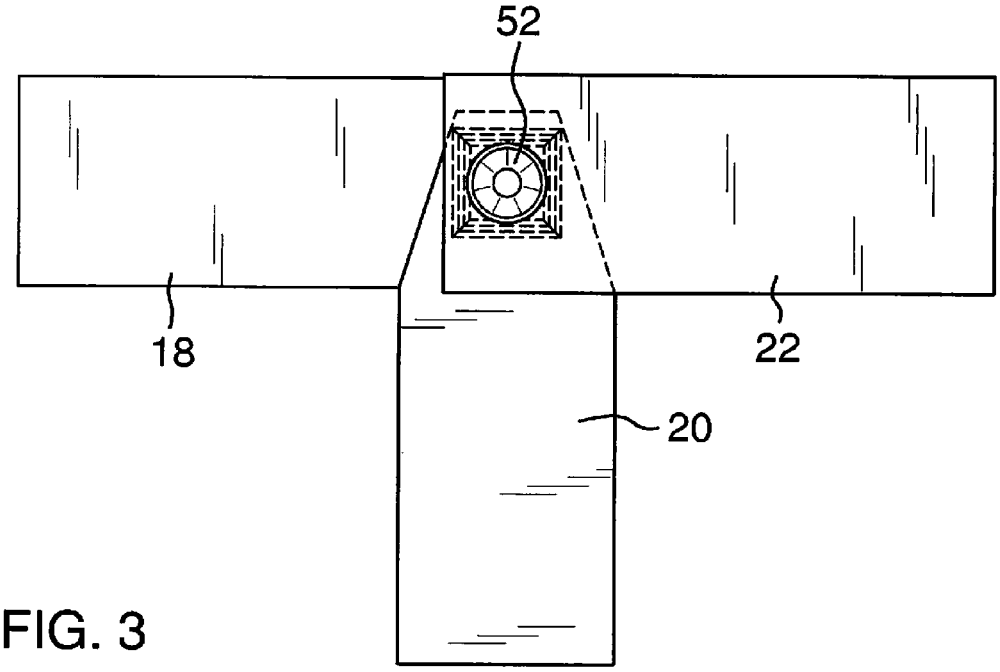
FIG. 3 is a top view of an embodiment of the disclosure.
Figure 4:
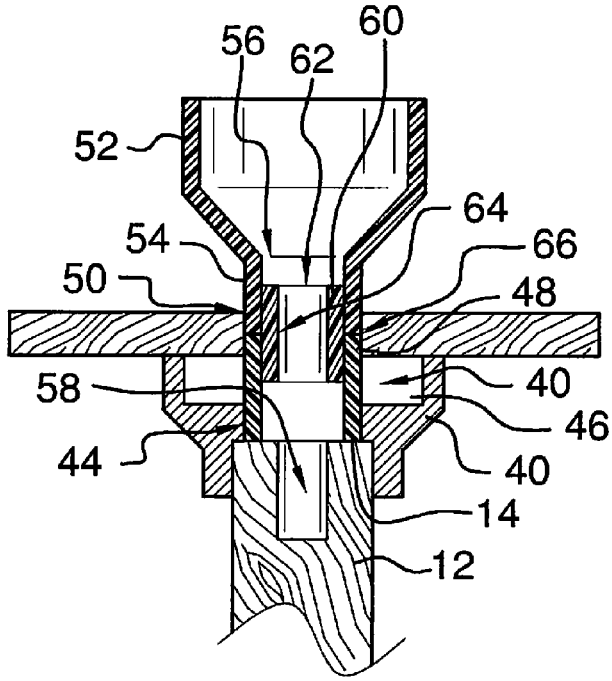
FIG. 4 is a cross-sectional view of an embodiment of the disclosure taken along line 4-4 of FIG. 2.
Figure 5:
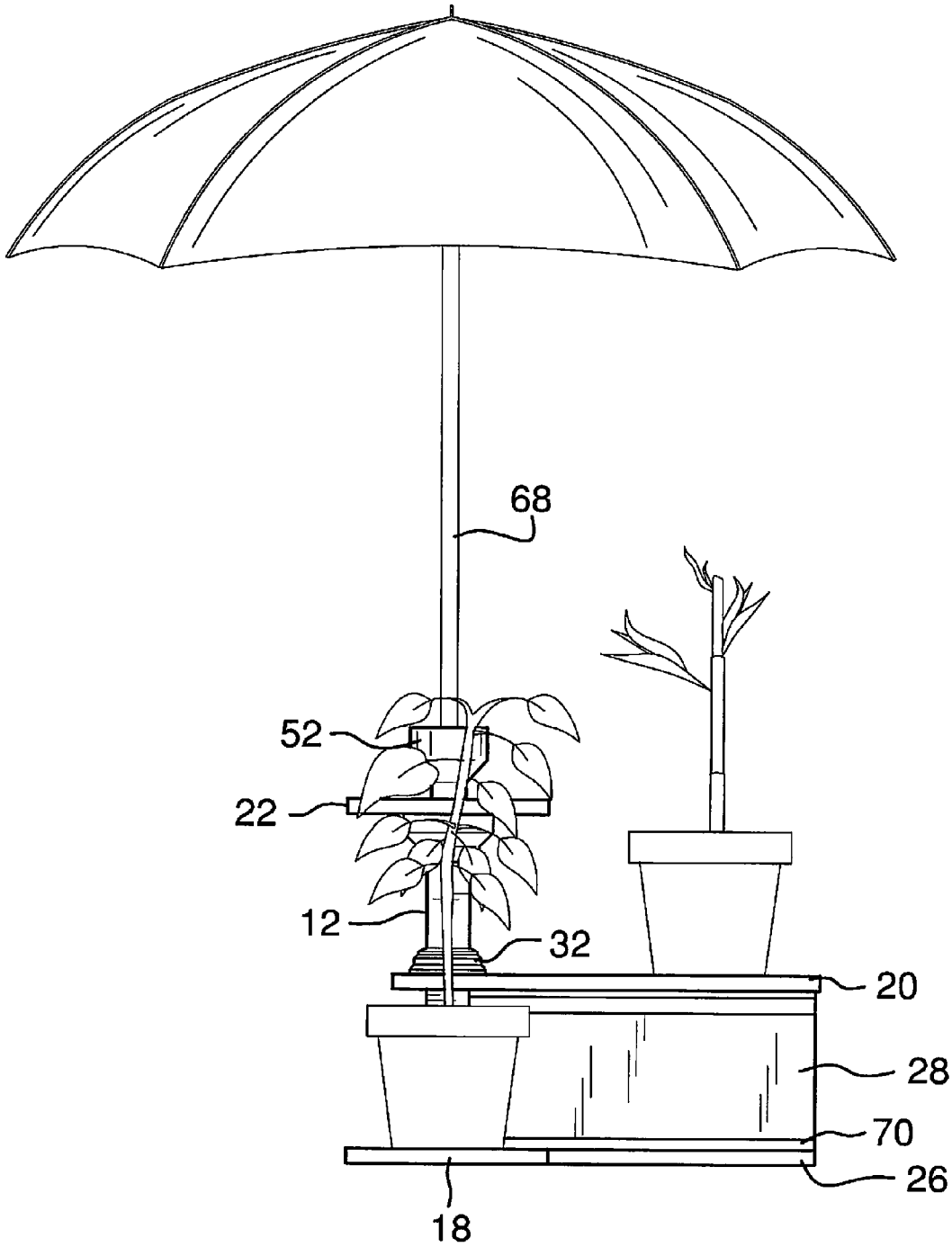
FIG. 5 is a back view of an embodiment of the disclosure in use.

With reference now to the drawings, and in particular to FIGS. 1 through 5 thereof, a new table device embodying the principles and concepts of an embodiment of the disclosure and generally designated by the reference numeral 10 will be described.

As best illustrated in FIGS. 1 through 5, the adjustable table assembly 10 generally comprises a post 12 having an upper end 14 and a lower end 16. A base 18 is coupled to the lower end 16 of the post 12. A shelf 20 is coupled to and extends from the post 12. An upper panel 22 is coupled to and extends from the post 12. The upper panel 22 is pivotally coupled to the post 12. A support assembly 24 is coupled to and extends downwardly from the shelf 20. The support assembly 24 has a bottom panel 26 and a vertical panel 28 coupled to and extending upwardly from a top surface 30 of the bottom panel 26.

A shelf cover 32 may be coupled to the post 12 to obscure view of the connection between the shelf 20 and the post 12. The shelf cover 32 extends around the post 12 and abuts a top surface 34 of the shelf 20. Similarly, a base cover 36 may be coupled to the post 12. The base cover 36 extends around the post 12 and abuts a top surface 38 of the base 18.

A crown 40 is coupled to the upper end 14 of the post 12. The upper panel 22 rests on the crown 40. The crown 40 has a central aperture 42 having a lower portion 44 and an upper portion 46. An alignment collar 48 is seated in the lower portion 44 of the central aperture 42 of the crown 40. The alignment collar 48 extends upwardly out of the central aperture 42. The alignment collar 48 further extends into an aperture 50 in the upper panel 22 whereby the upper panel 22 is pivotable around the alignment collar 48. A holder 52 has a lower portion 54 insertable into the aperture 50 in the upper panel 22. The lower portion 54 of the holder 52 abuts the alignment collar 48. The alignment collar 48 and the holder 52 form a cavity 56 extending upwardly from the upper end 14 of the post 12. A hole 58 extends into the upper end 14 of the post 12. An internal collar 60 is positioned in the cavity 56 extending upwardly from the upper end 14 of the post 12. The internal collar 60 has a conduit 62 extending through the internal collar 60. The conduit 62 is aligned with the hole 58 in the upper end 14 of the post 12. A medial section 64 of the internal collar 60 may be aligned with a junction 66 between the holder 52 and the alignment collar 48. A device 68 such as an umbrella may be inserted into the holder 52 through the conduit 62 in the internal collar 60 and into the hole 58 in the upper end 14 of the post 12.

A U-shaped channel support 70 may be coupled to the top surface 38 of the base 18 and the top surface 30 of the bottom panel 26 of the support assembly 24. The channel support 70 extends outwardly from the post 12. The vertical panel 28 of the support assembly 24 is positioned in the channel support 70.

In use, the shelf 20 is positioned at an angle, which may be a right angle, relative to the base 18. Each of the base 18 and the shelf 20 are elongated. The shelf 20 may have tapered edges proximate the post 12. The shelf 20 is static relative to the base 18 as the base 18 and the bottom panel 26 are adjacent and coplanar. The upper panel 22 pivots relative to the post 12 so that the assembly 10 may be placed adjacent to a fixed chair or the like, such as a swinging bench, so that a person may swing the upper panel 22 into a convenient position for holding items such as a drink and a plate of food in an accessible position while the person is seated in the fixed chair. The shelf 20 may be utilized to hold plants, decorations, or other items as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A table assembly comprising:

a post having an upper end and a lower end;

a base coupled to said lower end of said post;

a shelf coupled to and extending from said post;

an upper panel coupled to and extending from said post, said upper panel being pivotally coupled to said post;

a support assembly coupled to and extending downwardly from said shelf, said support assembly having a bottom panel and a vertical panel coupled to and extending upwardly from a top surface of said bottom panel;

a crown coupled to said upper end of said post, said crown having a central aperture, said central aperture having a lower portion and an upper portion;

an alignment collar being seated in said lower portion of said central aperture of said crown, said alignment collar extending upwardly out of said central aperture; and said upper panel resting on said crown, said alignment collar extending into an aperture in said upper panel whereby said upper panel is pivotable around said alignment collar.

2. The assembly of claim 1, further including a shelf cover coupled to said post, said shelf cover extending around said post, said shelf cover abutting a top surface of said shelf.

3. The assembly of claim 1, further including a base cover coupled to said post, said base cover extending around said post, said base cover abutting a top surface of said base.

4. The assembly of claim 1, further including a holder having a lower portion insertable into said aperture in said upper panel, said lower portion of said holder abutting said alignment collar, said alignment collar and said holder forming a cavity extending upwardly from said upper end of said post.

5. The assembly of claim 4, further comprising:

a hole extending into said upper end of said post, an internal collar positioned in said cavity extending upwardly from said upper end of said post, said internal collar having a conduit extending through said internal collar, said conduit being aligned with said hole in said upper end of said post.

6. The assembly of claim 5, further including a medial section of said internal collar being aligned with a junction between said holder and said alignment collar.

7. The assembly of claim 1, further including a U-shaped channel support coupled to a top surface of said base and a top surface of said bottom panel of said support, said channel support extending outwardly from said post, said vertical panel of said support being positioned in said channel support.

8. A table assembly comprising:

a post having an upper end and a lower end;

a base coupled to said lower end of said post;

a shelf coupled to and extending from said post;

an upper panel coupled to and extending from said post, said upper panel being pivotally coupled to said post;

a support assembly coupled to and extending downwardly from said shelf, said support assembly having a bottom panel and a vertical panel coupled to and extending upwardly from a top surface of said bottom panel;

a shelf cover coupled to said post, said shelf cover extending around said post, said shelf cover abutting a top surface of said shelf;

a base cover coupled to said post, said base cover extending around said post, said base cover abutting a top surface of said base;

a crown coupled to said upper end of said post, said upper panel resting on said crown, said crown having a central aperture, said central aperture having a lower portion and an upper portion;

an alignment collar being seated in said lower portion of said central aperture of said crown, said alignment collar extending upwardly out of said central aperture, said alignment collar extending into an aperture in said upper panel whereby said upper panel is pivotable around said alignment collar;

a holder having a lower portion insertable into said aperture in said upper panel, said lower portion of said holder abutting said alignment collar, said alignment collar and said holder forming a cavity extending upwardly from said upper end of said post;

a hole extending into said upper end of said post, an internal collar positioned in said cavity extending upwardly from said upper end of said post, said internal collar having a conduit extending through said internal collar, said conduit being aligned with said hole in said upper end of said post;

a medial section of said internal collar being aligned with a junction between said holder and said alignment collar; and a U-shaped channel support coupled to a top surface of said base and a top surface of said bottom panel of said support, said channel support extending outwardly from said post, said vertical panel of said support being positioned in said channel support.

9. A table assembly comprising:

a post having an upper end and a lower end;

a base coupled to said lower end of said post;

a shelf coupled to and extending from said post;

an upper panel coupled to and extending from said post, said upper panel being pivotally coupled to said post;

a support assembly coupled to and extending downwardly from said shelf, said support assembly having a bottom panel and a vertical panel coupled to and extending upwardly from a top surface of said bottom panel; and a U-shaped channel support coupled to a top surface of said base and a top surface of said bottom panel of said support, said channel support extending outwardly from said post, said vertical panel of said support being positioned in said channel support.

10. The assembly of claim 9, further including a shelf cover coupled to said post, said shelf cover extending around said post, said shelf cover abutting a top surface of said shelf.

11. The assembly of claim 9, further including a base cover coupled to said post, said base cover extending around said post, said base cover abutting a top surface of said base.

12. The assembly of claim 9, further comprising:

a crown coupled to said upper end of said post, said crown having a central aperture, said central aperture having a lower portion and an upper portion;

an alignment collar being seated in said lower portion of said central aperture of said crown, said alignment collar extending upwardly out of said central aperture; and said upper panel resting on said crown, said alignment collar extending into an aperture in said upper panel whereby said upper panel is pivotable around said alignment collar.

13. The assembly of claim 12, further including a holder having a lower portion insertable into said aperture in said upper panel, said lower portion of said holder abutting said alignment collar, said alignment collar and said holder forming a cavity extending upwardly from said upper end of said post.

14. The assembly of claim 13, further comprising:

a hole extending into said upper end of said post, an internal collar positioned in said cavity extending upwardly from said upper end of said post, said internal collar having a conduit extending through said internal collar, said conduit being aligned with said hole in said upper end of said post.

15. The assembly of claim 14, further including a medial section of said internal collar being aligned with a junction between said holder and said alignment collar.

* * * * *